US006964216B2

(12) United States Patent
Chen

(10) Patent No.: US 6,964,216 B2
(45) Date of Patent: Nov. 15, 2005

(54) SELECTIVE ONE-WAY WRENCH

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 28 days.

(21) Appl. No.: 10/724,231

(22) Filed: Dec. 1, 2003

(65) Prior Publication Data

US 2005/0092135 A1 May 5, 2005

(30) Foreign Application Priority Data

Oct. 29, 2003 (TW) ..... 92130012 A

(51) Int. Cl.[7] ..... B25B 13/46

(52) U.S. Cl. ..... 81/63.1

(58) Field of Search ..... 81/62, 61, 63.1, 81/177.85; 192/43.1

(56) References Cited

U.S. PATENT DOCUMENTS 4,420,995 A * 12/1983 Roberts ..... 81/60
2003/0051583 A1 * 3/2003 Lin ..... 81/60

* cited by examiner

*Primary Examiner*—Debra S Meislin
(74) *Attorney, Agent, or Firm*—Charles E. Baxley

(57) ABSTRACT

A selective one-way wrench includes a handle, an annular head, a gear, a direction controller and a direction switch. The handle projects from an annular head. The annular head defines a first space and a second space communicated with the first space. The gear is rotationally put in the first space. The gear includes a toothed external face. A direction controller is put in the second space. The direction controller includes two pawls and a spring installed between the pawls. Each of the pawls includes a toothed face. The direction switch includes a first element installed rotationally on the handle and a second element put in the second space and operably connected with the first element for bringing the toothed face of selective one of the pawls into engagement with the toothed external face of the annular gear.

4 Claims, 8 Drawing Sheets

SELECTIVE ONE-WAY WRENCH

This nonprovisional application claims priority under 35 U.S.C. §119(a) on Patent Application No. 92130012 filed in TAIWAN on Oct. 29, 2003, the entire contents of which are hereby incorporated by reference.

FIELD OF INVENTION

The present invention relates to a selective one-way wrench.

BACKGROUND OF INVENTION

Referring to FIG. 8, a conventional selective one-way wrench 80 includes a handle 92, an annular head 81, an annular gear 86, a direction controller 87 and a direction switch 90. The annular head 81 is formed at an end of the handle 92. The annular head 81 defines a first space 82, a second space 83 communicated with the first space 82, a third space 89 communicated with the second space 83 and a recess 84 communicated with the third space 89. The annular gear 86 is rotationally put in the first space 82. The annular gear 86 includes a toothed external face 99 formed thereon. The direction controller 87 is put in the second space 83. The direction controller 87 includes two pawls 94 and 95 and a spring 88 installed between the pawls 94 and 95. The pawl 94 includes a toothed face 96 formed thereon. The pawl 95 includes a toothed face 97 formed thereon. The direction switch 90 is rotationally installed in the recess 84 of the handle 92 and partially put in the third space 89 for bringing the toothed face 96 of the pawl 94 or the toothed face 97 of the pawl 95 into engagement with the toothed external face 99 of the annular gear 86.

The present invention is therefore intended to obviate or at least alleviate the problems encountered in prior art.

SUMMARY OF INVENTION

The primary objective of the present invention is to provide a selective one-way wrench.

A selective one-way wrench includes a handle, an annular head, a gear, a direction controller and a direction switch. The handle projects from an annular head. The annular head defines a first space and a second space communicated with the first space. The gear is rotationally put in the first space. The gear includes a toothed external face. A direction controller is put in the second space. The direction controller includes two pawls and a spring installed between the pawls. Each of the pawls includes a toothed face. The direction switch includes a first element installed rotationally on the handle and a second element put in the second space and operably connected with the first element for bringing the toothed face of selective one of the pawls into engagement with the toothed external face of the annular gear.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF EMBODIMENTS

Figure 1:
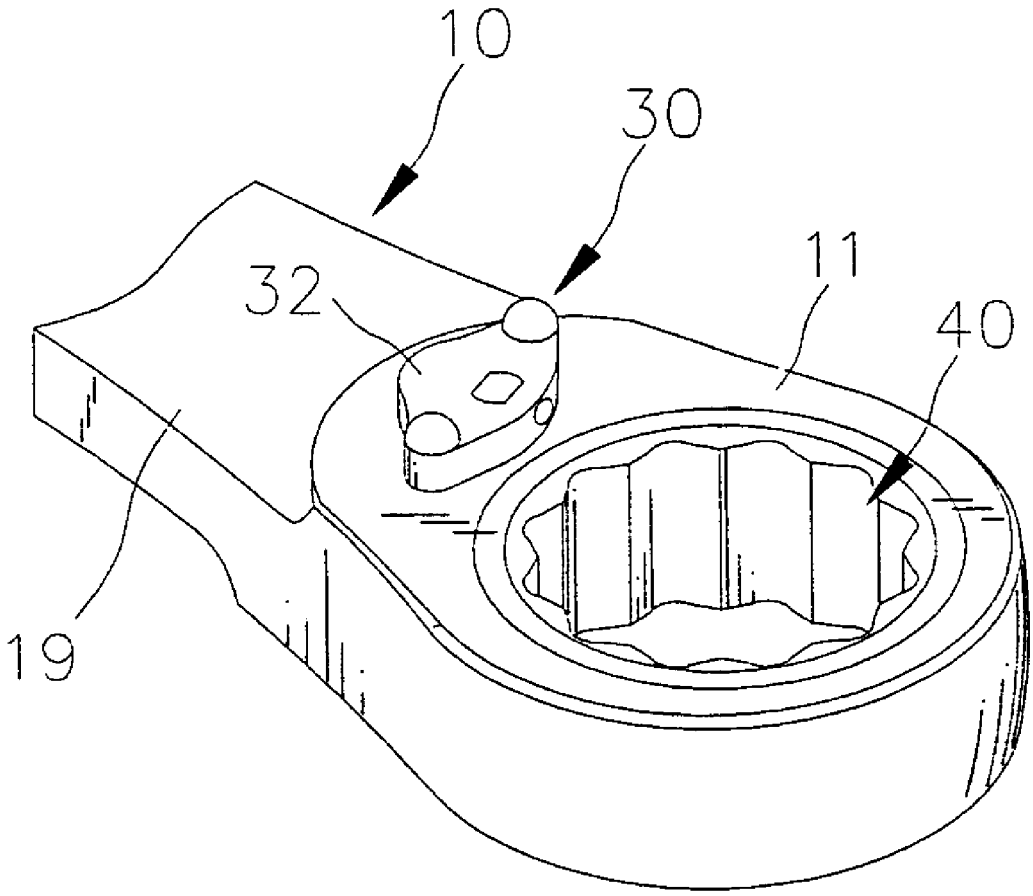
FIG. 1 is a perspective view of a selective one-way wrench according to a first embodiment of the present invention.

Referring to FIG. 1, according to a first embodiment of the present invention, a selective one-way wrench 10 includes a handle 19 and an annular head 11 from which the handle 19 projects.

Figure 2:
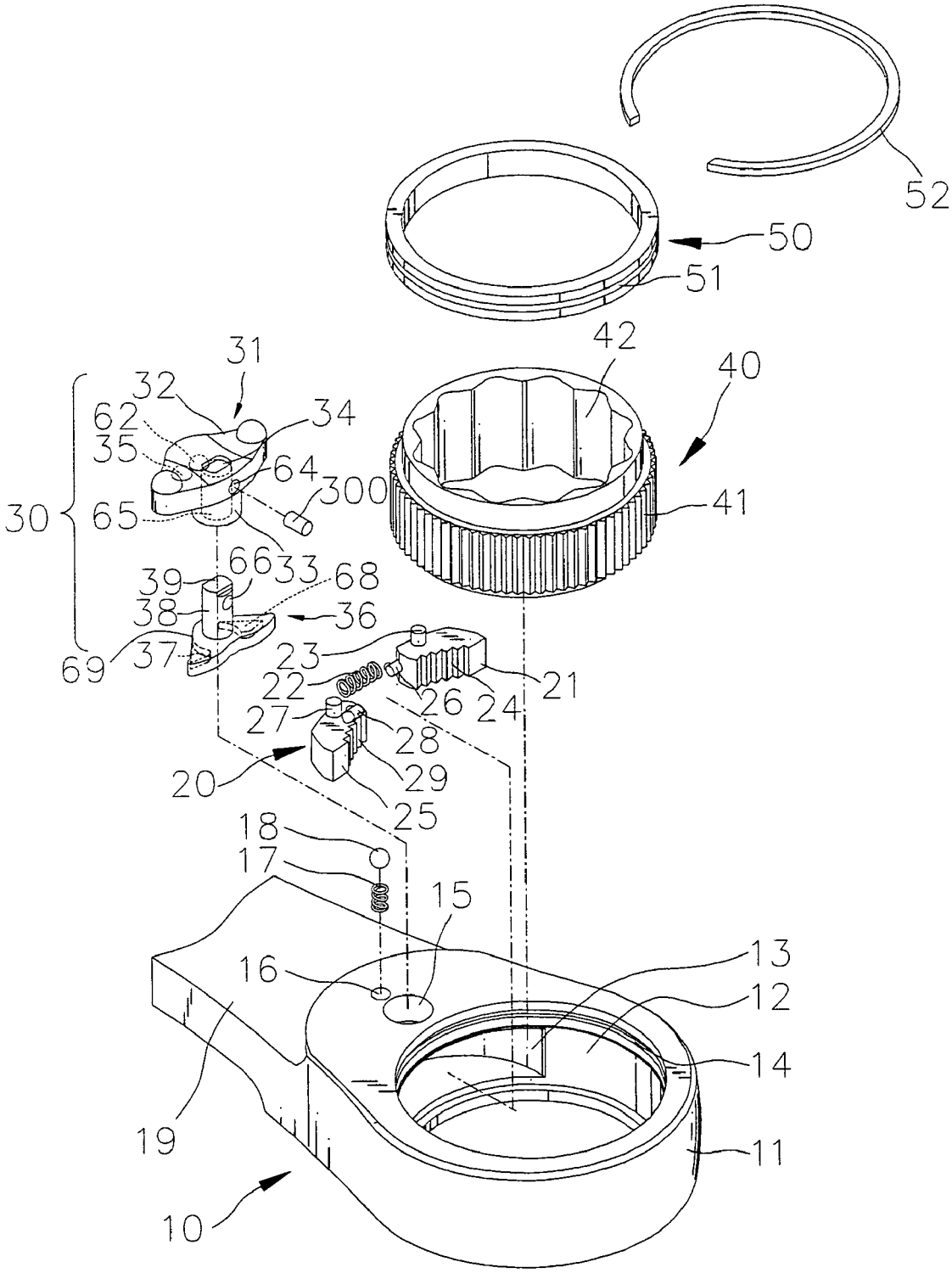
FIG. 2 is an exploded view of the selective one-way wrench shown in FIG. 1.

Referring to FIG. 2, the annular head 11 defines a circular space 12, a crescent space 13 communicated with the circular space 12. An annual groove 14 is defined in the wall of the circular space 12. An aperture 15 and a recess 16 are defined in the handle 19 near the circular space 12.

A direction controller 20 is put in the crescent space 13. The direction controller 20 includes two pawls 21 and 25 and a spring 22 for connecting the pawl 21 with the pawl 25.

The pawl 21 includes a top, a bottom, a planar side, a toothed side 24, an arched side, a boss 26 formed on the planar side and a rod 23 formed on the top.

The pawl 25 includes a top, a bottom, a planar side, a toothed side 29, an arched side, a boss 28 formed on the planar side and a rod 27 formed on the top.

The spring 22 includes an end in which the boss 26 is fit and opposite end in which the boss 28 is fit. Thus, the pawl 21 is firmly connected with the pawl 25 by means of the spring 22.

An O-ring 50 is put in the circular space 12. The O-ring 50 includes an annular groove 51 defined in an external face thereof.

A C-ring 52 includes an internal edge put in the annular groove 51 and an external edge put in the annular groove 14. Thus, the O-ring 50 is firmly attached to the annular head 11 by means of the C-ring 52.

An annular gear 40 is put in the circular space 12. The annular gear 40 is put on the O-ring 50 rotationally. The annular gear 40 includes a toothed internal face 42 for engagement with a bolt or nut and a toothed external face 41 for selective engagement with the pawl 21 or 25.

A spring 17 and a ball detent 18 are put in the recess 16.

A direction switch 30 includes a first element 31 and a second element 36. The first element 31 includes a handle 32 and a cylinder 33 extending from the handle 32. The handle 32 includes a slot 34 defined in a top, two recesses 35 and 62 defined in a bottom and an aperture 64 defined in a side. The cylinder 33 defines a hole 65 communicated with the apertures 34 and 64.

The second element 36 includes a rod 38 and two substantially opposite hooks 37 and 68 extending from the rod 38. Preferably, the hooks 37 and 68 are formed on a bottom of a reinforcement plate 69 that is formed at a lower end of the rod 38. A ridge 39 extends from the rod 38. A recess 66 is defined in the rod 38 near the ridge 39.

The second element 36 is put in the crescent space 13 before the direction controller 20. The rod 38 extends through the aperture 15. The first element 31 is put on the handle 19. The rod 38 is inserted into the cylinder 33. The first element 31 is firmly attached to the second element 36 by means of a pin 300 fit into the recess 66 through the aperture 64. Hence, the direction switch 30 is installed on the handle 19 and the annular head 11 rotationally. The ball detent 18 selectively enters the recess 35 or 62.

Figure 3:
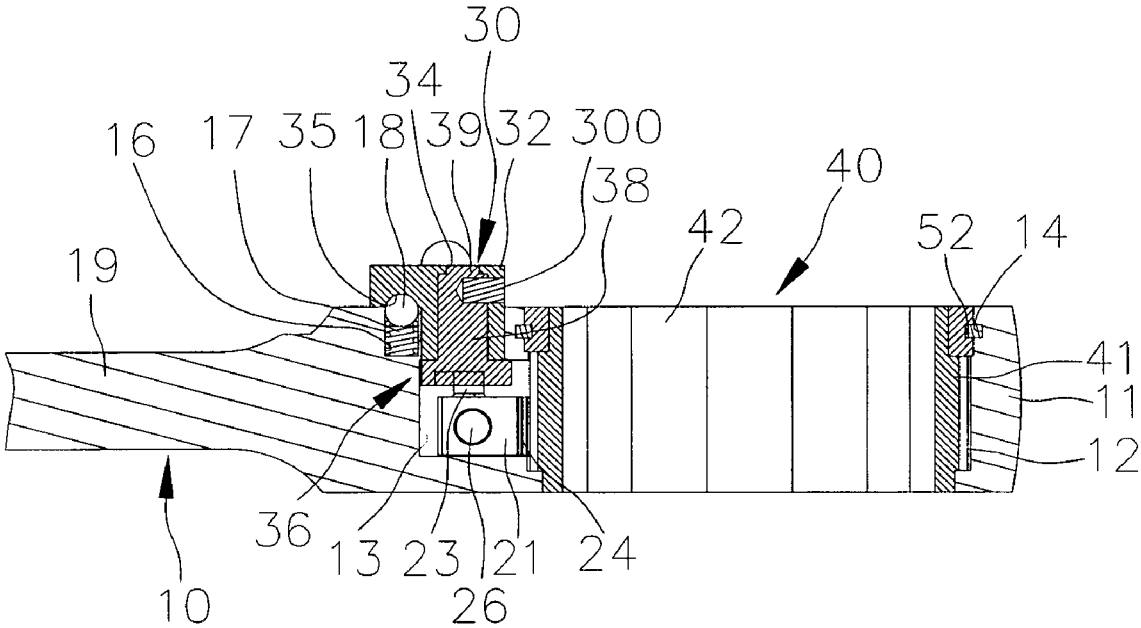
FIG. 3 is a cross-sectional view of the selective one-way wrench of FIG. 1.
Figure 4:
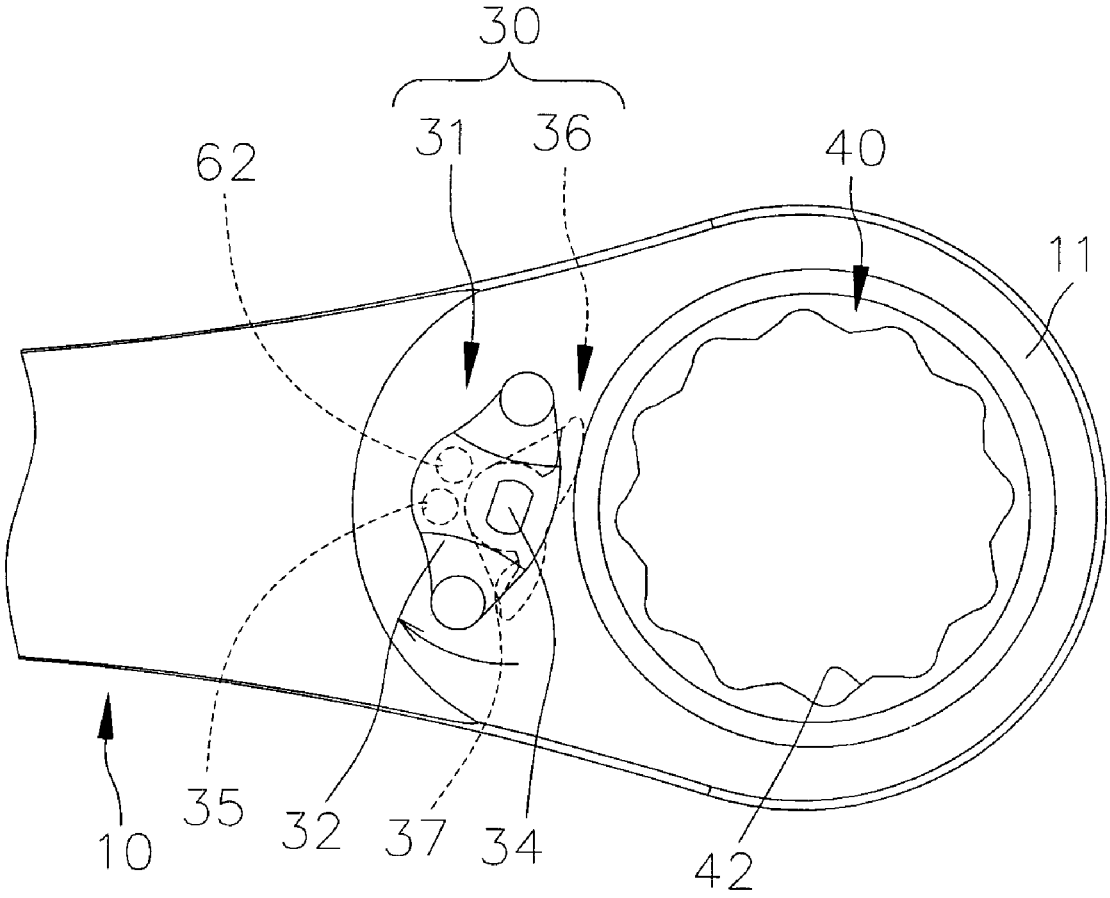
FIG. 4 is a top view of the selective one-way wrench of FIG. 1.
Figure 5:
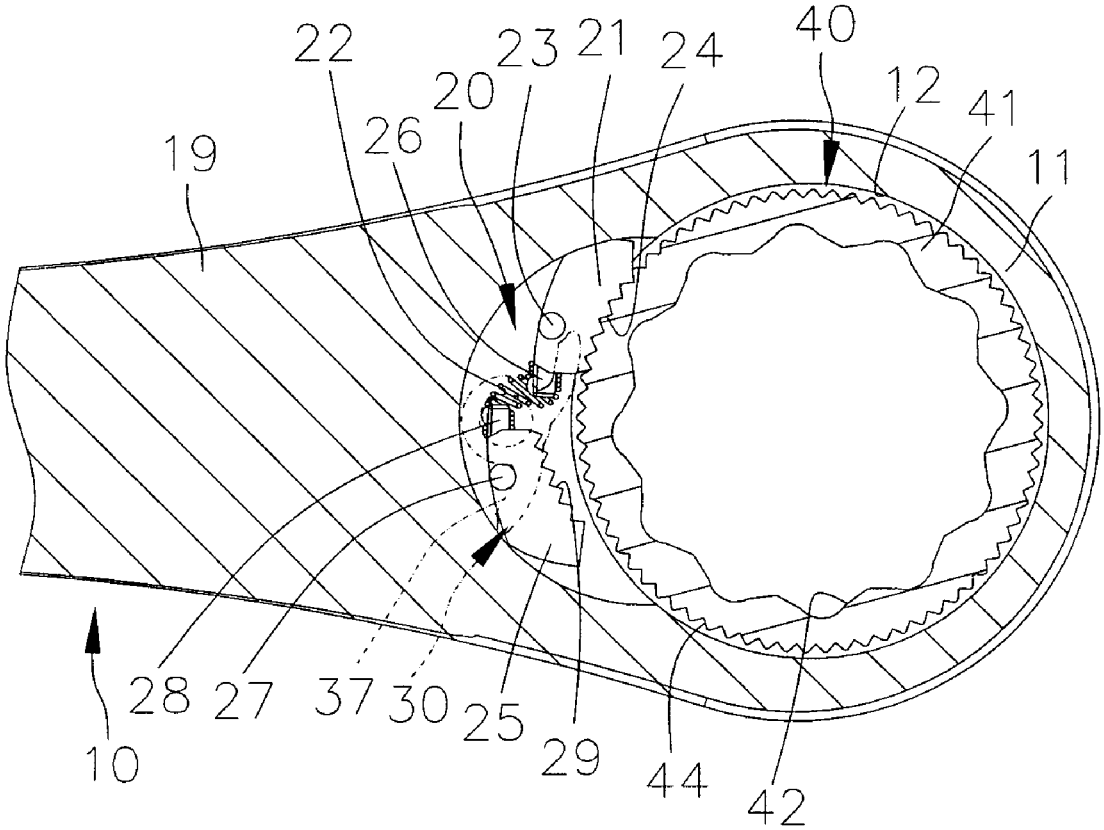
FIG. 5 is similar to FIG. 4 but shows the selective one-way wrench in a position for driving a bolt or nut counterclockwise.

Referring to FIGS. 3 to 5, the direction switch 30 is in a first position. The ball detent 18 enters the recess 35 so as to retain the direction switch 30 in the first position. The hook 37 of the second element 36 hooks the rod 27. The pawl 21 is moved into a right-hand end of the crescent space 13. Thus, the annular head 11 can drive the annular gear 40 counterclockwise, but not vice versa.

Although not shown, the direction switch 30 can be moved to a second position. The ball detent 18 enters the recess 62 so as to retain the direction switch 30 in the second position. The hook 68 of the second element 36 hooks the rod 23. The pawl 21 is moved into a left-hand end of the crescent space 13. Thus, the annular head 11 can drive the annular gear 40 clockwise, but not vice versa.

Figure 6:
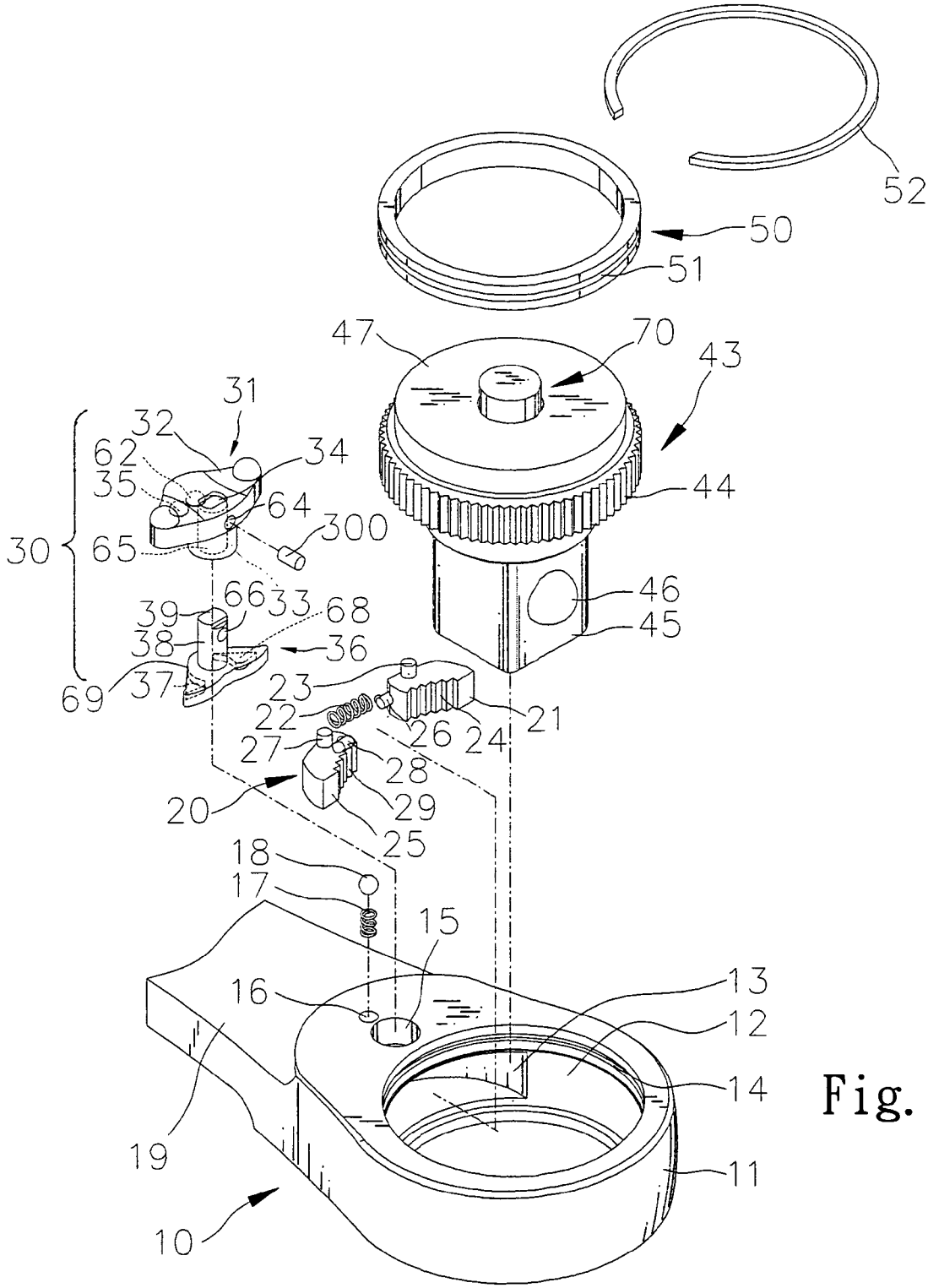
FIG. 6 is an exploded view of the selective one-way wrench according to a second embodiment of the present invention.
Figure 7:
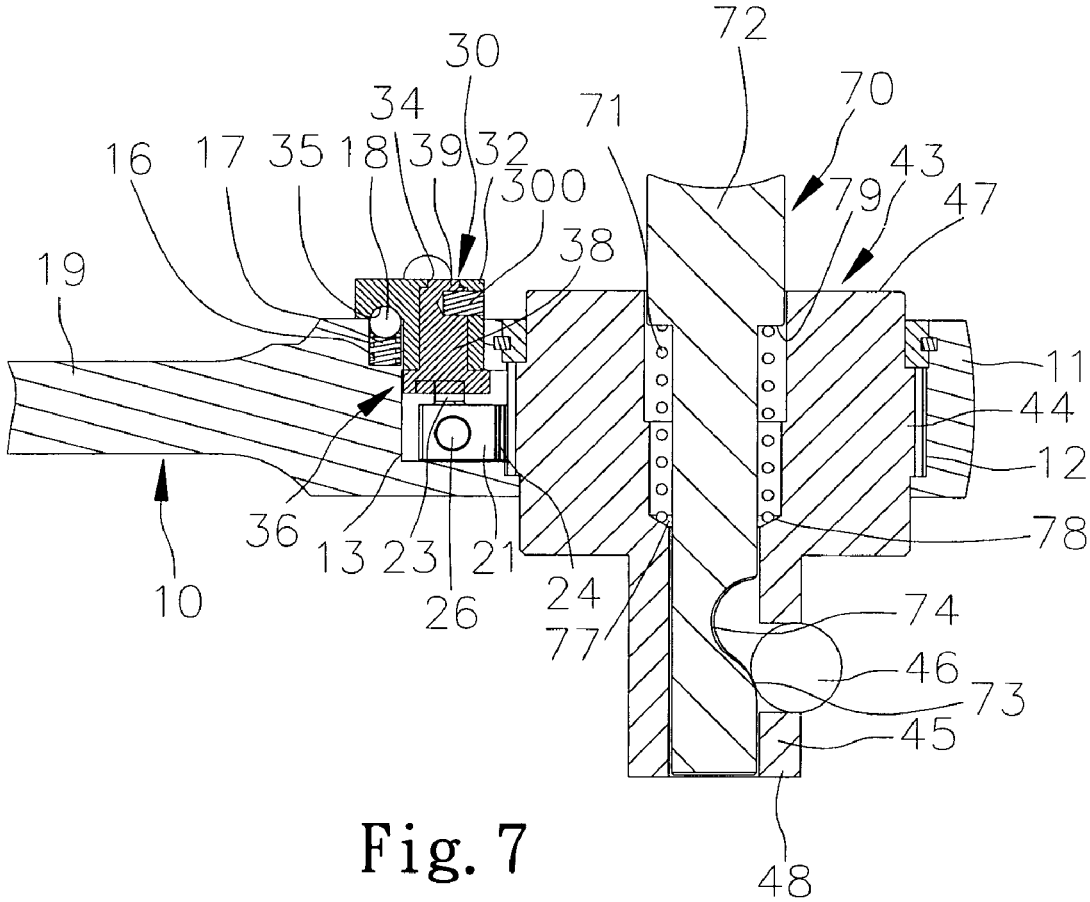
FIG. 7 is a cross-sectional view of the selective one-way wrench of FIG. 6.
Figure 8:
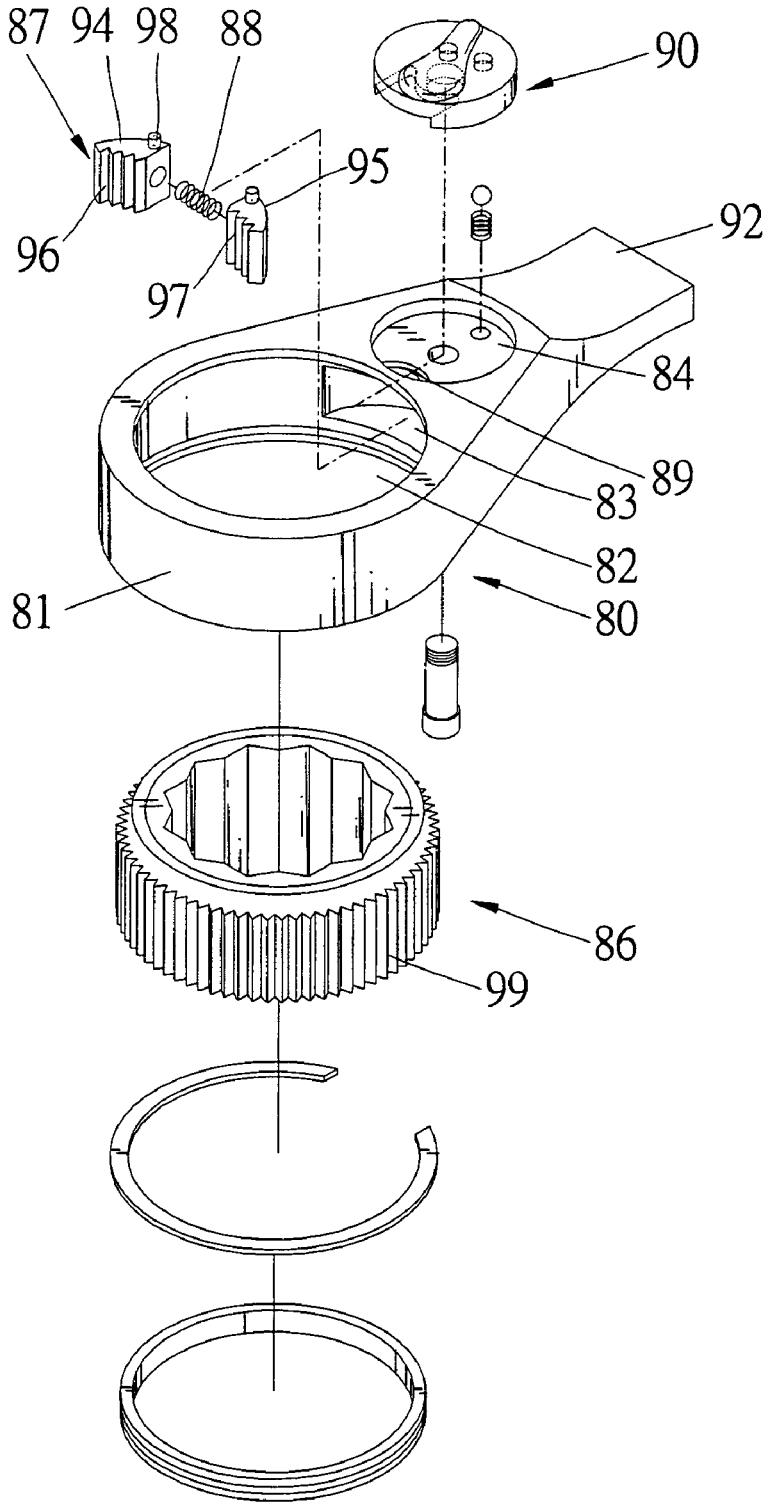
Fig. 8 PRIOR ART
FIG. 8 is an exploded view of a conventional selective one-way wrench.

FIGS. 6 and 7 show a selective one-way wrench according to a second embodiment of the present invention. The second embodiment is identical to the first embodiment except for replacing the annular gear 40 with a joint 43.

The joint 43 includes a plate 47 with a toothed face 44 formed on its periphery and a control device 70. On a bottom face of the plate 47 is formed a square insert 45 for insertion into a square hole defined in a socket (not shown). The square insert 45 includes a hole 48 defined therein.

The control device 70 includes a rod 72 and a spring 71. The rod 72 includes an upper section through the plate 47 and a narrow lower section into the square insert 45, thus forming an annual shoulder 79 between the sections thereof.

The rod 72 defines a hole 74 communicated with the hole 48 of the square insert 45. An inclined face 73 extends from the hole 74.

The joint 43 defines a space 77 for receiving the rod 72 and the spring 71. The space 77 includes an upper section and a narrow lower section, thus forming an annual shoulder 78 between the sections thereof. The spring 71 is compressed between the annular shoulders 78 and 79. Thus, the rod 72 is biased upward by means of the spring 71. Accordingly, a portion of a ball detent 46 is caused to extend from the hole 74 by means of the inclined face 73 of the rod 72. Therefore, the ball detent 46 can retain the socket on the square insert 45.

When a user pushes down the rod 72, the ball detent 46 can be inserted into the hole 74, i.e., the ball detent 46 can be completely concealed in the hole 74. Thus, the square insert 45 can be inserted into a square hole defined in a socket.

The present invention has been described through detailed illustration of two embodiments. Those skilled in the art can derive variation from the embodiments without departing from the scope of the present invention. Therefore, the embodiments shall not limit the scope of the present invention defined in the claims.

What is claimed is:

1. A selective one-way wrench comprising:

a handle;

an annular head from which the handle projects, the annular head defining a first space and a second space communicated with the first space;

a gear rotationally put in the first space, the gear including a toothed external face;

a direction controller put in the second space, the direction controller including two pawls and a spring installed between the pawls, each of the pawls including a toothed face; and a direction switch including a first element installed rotationally on the handle and a second element put in the second space and operable connected with the first element for bringing the toothed face of selective one of the pawls into engagement with the toothed external face of the annular gear wherein the first element includes a cylinder extending from a bottom thereof, and the second element includes a rod extending from a top thereof, and the cylinder of the first element receives the rod of the second element.

2. The selective one-way wrench according to claim 1 wherein the first element includes a slot communicated with a hole of the cylinder, and the second element includes a ridge extending from the rod, and the slot of the first element receives the ridge of the second element.

3. The selective one-way wrench according to claim 1 wherein the direction switch includes a pin forced into the rod of the second element through the cylinder of the first element.

4. The selective one-way wrench according to claim 1 wherein the second element includes a reinforcement plate and said rod extending from the reinforcement plate.

* * * * *